US006186418B1

(12) United States Patent
Tani

(10) Patent No.: US 6,186,418 B1
(45) Date of Patent: Feb. 13, 2001

(54) FUEL INJECTION NOZZLE

(75) Inventor: Yasuhide Tani, Nagoya (JP)

(73) Assignee: Denso Corporation (JP)

( * ) Notice: Under 35 U.S.C. 154(b), the term of this patent shall be extended for 0 days.

(21) Appl. No.: 09/386,480

(22) Filed: Aug. 31, 1999

(30) Foreign Application Priority Data

Sep. 25, 1998 (JP) ..... 10-270962

(51) Int. Cl.[7] ..... F02M 59/00; F02M 61/00; F02M 63/00

(52) U.S. Cl. ..... 239/533.2; 239/533.12

(58) Field of Search ..... 239/533.12, 533.2, 239/533.3, 558

(56) References Cited

U.S. PATENT DOCUMENTS 4,699,323 10/1987 Rush et al. ..... 239/585
4,828,184 * 5/1989 Gardner et al. ..... 239/590.3
5,752,316 * 5/1998 Takagi et al. ..... 29/888.4
5,899,390 * 5/1999 Arndt et al. ..... 239/533

FOREIGN PATENT DOCUMENTS 4-72456 6/1992 (JP) .

* cited by examiner

*Primary Examiner*—Andres Kashnikow
*Assistant Examiner*—Davis Hwu
(74) *Attorney, Agent, or Firm*—Nixon & Vanderhye PC

(57) ABSTRACT

Twelve injection holes formed on an injection hole member are separated into two groups, each one of the two groups has six injection holes for forming a spray. Each injection hole is formed such that its injected fuel flow path center diverges from an injection center axis as fuel advances in an injection direction. Respective injected fuel flow path centers diverge from each other as fuel advances in the injection direction. Accordingly, fuel injected from the injection holes do not collide each other and form sprays. Thus, the spray is uniformly atomized, and a deviation of the spray direction is prevented.

9 Claims, 3 Drawing Sheets

FUEL INJECTION NOZZLE

CROSS REFERENCE TO RELATED APPLICATION

This application is based upon and claims priority from Japanese Patent Application No. Hei 10-270962 filed Sep. 25, 1998, the contents of which are incorporated herein by reference.

BACKGROUND OF THE INVENTION

1. Field of the Invention

This invention relates to a fuel injection nozzle having a plurality of spray patterns.

2. Description of Related Art

When a fuel injection valve injects fuel into an engine having a plurality of intake valves in a combustion chamber, one type of known fuel injection nozzle has a plurality of injection holes formed on an injection hole member to form a fuel spray toward respective intake valves according to fuel injected through several groups of the plurality of injection holes, and forms several sprays as a whole. For example, a fuel injection valve disclosed in JP-A-62-261664 forms respective sprays by colliding fuel injected through grouped plural injection holes.

However, when the spray is formed by colliding fuel injected from respective injection holes, there may be a deviation among the spray diameters, and a uniform atomization may not be achieved. Furthermore, the spray direction may deviate according to a change in fuel injection pressure or a change in fuel collision angle.

It is to be noted that the spray direction has a general tendency to be variable when t/d is small and the spray atomization has a general tendency to be prevented when t/d is large, where "t" represents a thickness of the injection hole member and "d" represents a diameter of the injection hole. Accordingly, it is difficult to satisfy both these requirements, that is, stabilizing spray direction and atomization of the spray.

SUMMARY OF THE INVENTION

The present invention was made in light of the foregoing problems, and it is an object of the present invention to provide a fuel injection nozzle which realizes both stabilizing spray direction and the atomization of the spray.

According to a fuel injection nozzle of the present invention, it includes an injection hole member having a plurality of injection holes defining respective injected fuel flow path centers and a valve member provided on a fuel inlet side of the injection hole member for enabling fuel to be intermittently injected through the injection holes.

The fuel injected through the injection holes forms a spray. The injected fuel flow path centers diverge from an injection center axis as the fuel advances in an injection direction. Furthermore, the injected fuel flow path centers diverge from each other as the fuel advances in the injection direction.

Accordingly, fuel injected from respective injection holes do not collide each other. Therefore, the fuel spray is uniformly atomized.

Furthermore, fuel injected from respective injection holes attract each other by Coanda effect and advance without colliding with each other. Thus, a deviation of the spray direction is prevented, and the spray direction is stabilized.

BRIEF DESCRIPTION OF THE DRAWINGS

Other objects, features and characteristics of the present invention, as well as the functions of the related parts, will be appreciated from the following detailed description and the drawings, all of which form a part of this application. In the drawings.

DETAILED DESCRIPTION OF PREFERRED EMBODIMENTS

A preferred embodiment of the present invention will now be described according to the accompanying drawings.

Figure 3:
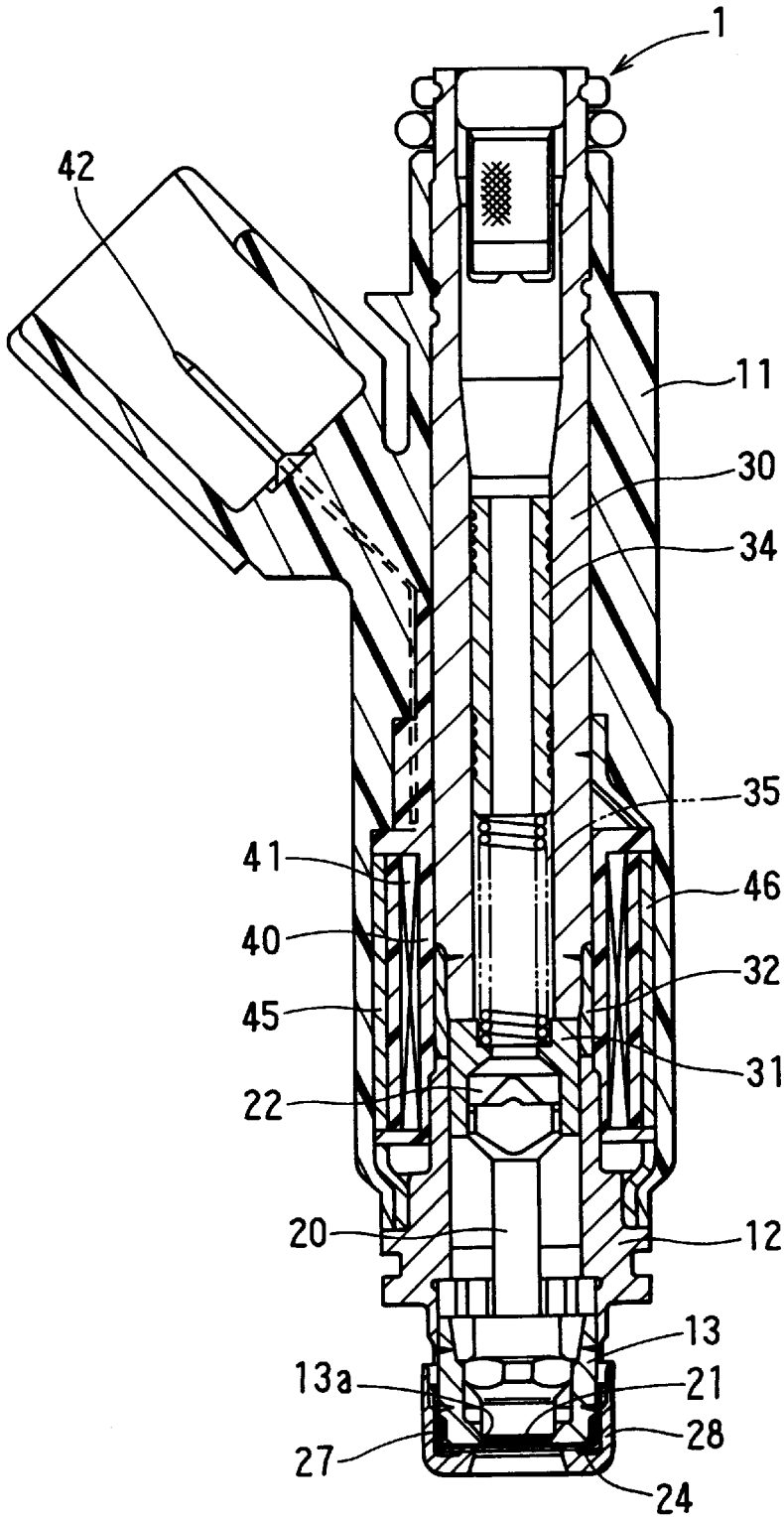
FIG. 3 is a sectional view showing a fuel injection valve according to the preferred embodiment of the present invention.

FIG. 3 is a sectional view showing a fuel injection valve for a gasoline engine to which a fuel injection nozzle of the present invention is applied. Two sprays are formed by fuel injected from a fuel injection valve 1.

A casing 11 made of a molding resin covers a magnetic pipe 12, a fixed core 30 and a coil 41 wound around a spool 40. A valve body 13 is connected to the magnetic pipe 12 by a laser beam welding or the like.

A needle valve 20 as a valve member is reciprocatably housed in the magnetic pipe 12 and the valve body 13. An abutting portion 21 of the needle valve 20 is provided such that it is seatable on a valve seat 13*a* formed on the valve body 13.

A connecting portion 22 provided on the opposite side of the abutting portion 21 is connected to a moving core 31. The fixed core 30 and a non-magnetic pipe 32, and the non-magnetic pipe 32 and the magnetic pipe 12 are respectively connected by the laser beam welding or the like.

A spring 35, for applying its spring force on the needle valve 20 toward the valve seat 13*a*, is provided on an opposite side to a fuel inlet side of an adjusting pipe 34. The spring force of the spring 35 for biasing the needle valve 20 is adjustable by changing an axial position of the adjusting pipe 34.

The fixed core 30 is located such that it sandwiches the non-magnetic pipe 32 in the axial direction. The coil 41 is located in the casing 11 such that it covers respective ends of the fixed core 30 and the magnetic pipe 12 and a periphery of the non-magnetic pipe 32.

The coil 41 is electrically connected to a terminal 42 such that a voltage is applied to the coil 41 via the terminal 42.

Metal plates 45, 46 are provided to cover the periphery of the spool 40. The metal plates 45, 46 form a magnetic circuit with the magnetic pipe 12, the fixed core 30 and the moving core 31.

When the coil 41 is energized, it generates an electromagnetic attractive force on the fixed core 30 to attract the moving core 31. When the fixed core 30 attracts the moving core 31 with the electromagnetic attractive force, the needle valve 20 also shifts toward the fixed core 30, and the abutting portion 21 is separated from the valve seat 13*a*.

When the current supply to the coil 41 is turned off and the electromagnetic attractive force disappears, the moving core 31 and the needle valve 20 shift toward the valve seat 13*a* because of the spring force of the spring 35. Accordingly, the abutting portion 21 seats on the valve seat 13*a*.

Figure 2:
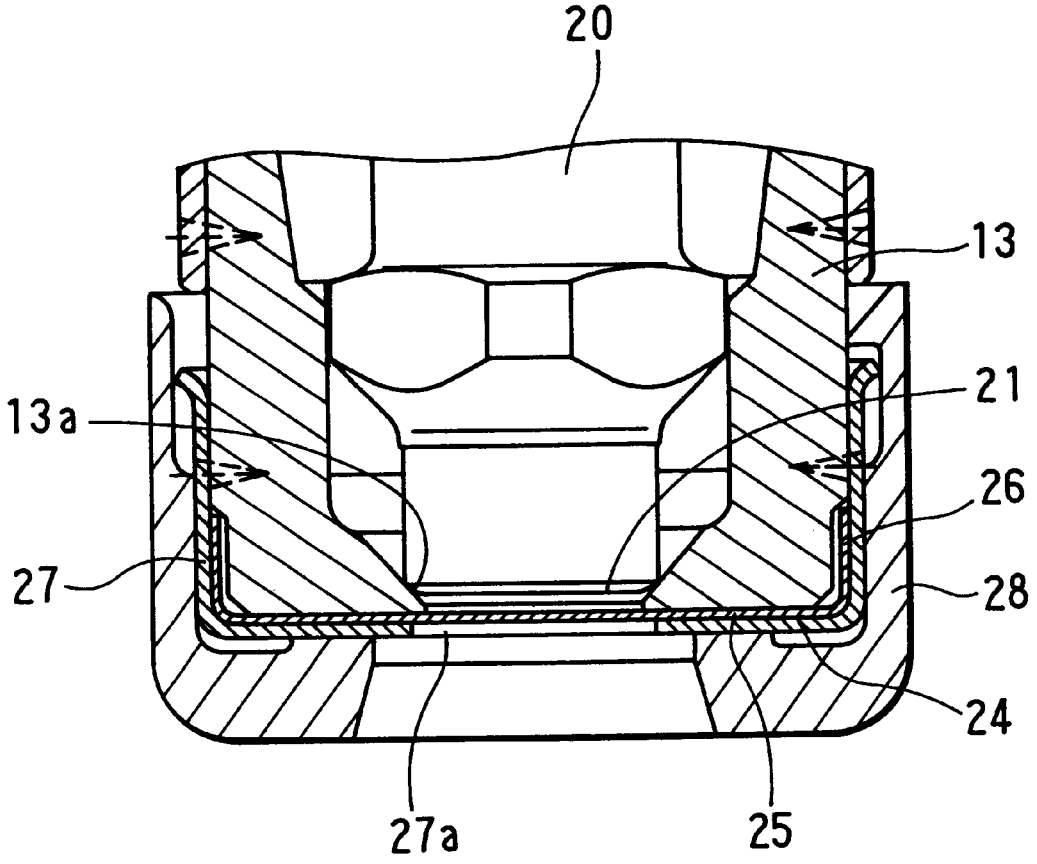
FIG. 2 is an enlarged sectional view showing a fuel injection nozzle according to the preferred embodiment of the present invention.

As shown in FIG. 2, an injection hole member 24, formed by a thin plate having a cup shape, is provided on an end of fuel injection side of the valve body 13. The injection hole member 24 has a thin disk portion 25 and a bent portion 26 bent at a circumferential edge of the disk portion 26.

Figure 1A:
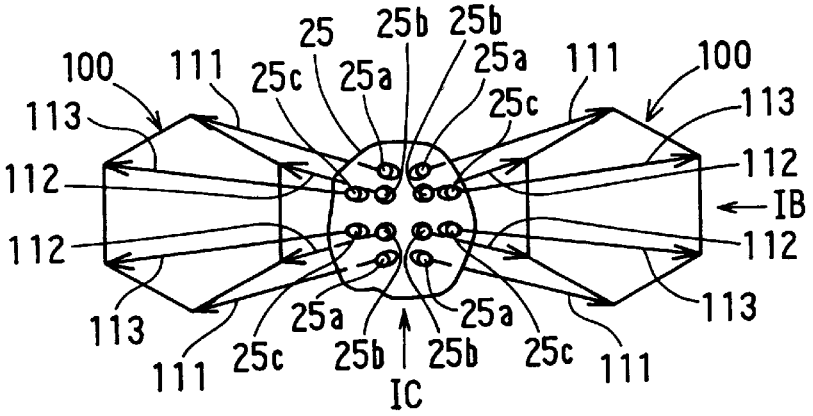
FIG. 1A is a plan view of an injection hole member and a shape of a spray viewed from a fuel inlet side according to a preferred embodiment of the present invention.

As shown in FIG. 1A, the disk portion 25 has a plurality of injection holes 25*a*, 25*b* and 25*c*. A thickness "t" of the disk portion 25 and a diameter "d" of each injection hole have the following relationship:

$$0.35<t/d<0.75$$

When the needle valve 20 shown in FIG. 2 is separated from the valve seat 13*a*, fuel starts to be injected from respective injection holes.

A cup-shaped retaining member 27 is provided at a fuel outlet side of the injection hole member 24. The injection hole member 24 and the retaining member 27 are connected by the laser beam welding such that the retaining member 27 supports the injection hole member 24.

A through hole 27*a* through which fuel to be injected from respective injection holes passes is formed on the retaining member 27. A cylindrical sleeve 28 covers the injection hole member 24 and the retaining member 27.

Injection holes formed on the injection hole member 24 and shapes of the spray formed by fuel injected from respective injection holes are now be described.

As shown in FIG. 1A, twelve injection holes are formed on the injection hole member 24. The twelve injection holes include four injection holes 25*a*, four injection holes 25*b* and four injection holes 25*c*. These twelve injection holes are separated into two groups, each has two injection holes 25*a*, two injection holes 25*b* and two injection holes 25*c*. Each group of injection holes forms a spray 100.

Extended lines 111, 112 and 113 represent flow path centers for each injection hole extended in the fuel injection direction. Intersections between the extended lines 111, 112 and 113 and a hypothetical plane which is 100 mm (=L) distant from the injection hole member 25 and which is perpendicular to an injection center axis 110 are approximately located on vertexes of the equilateral hexagons as shown in FIG. 1A. In this specification, "injection center axis" is an axis located in a center of the whole fuel sprays.

Figure 1B:
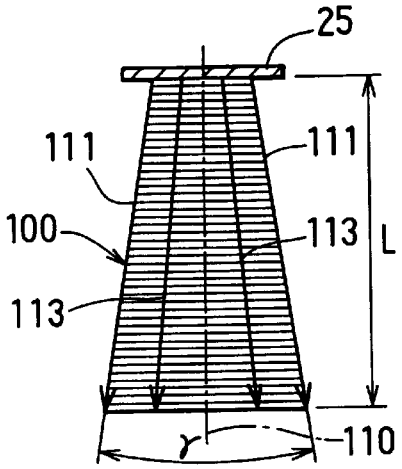
FIG. 1B is a side view of FIG. 1A viewed from an arrow IB in FIG. 1A according to the preferred embodiment of the present invention.

As shown in FIG. 1B, two extended lines 111 for two injection holes 25*a* form an angle of $\gamma$ between them when viewed from a direction of the arrow IB in FIG. 1A.

Compared with it, respective angles formed by two extendedlines 112 for two injection holes 25*b* and two extended lines 113 for two injection holes 25*c* are smaller than $\gamma$.

Figure 1C:
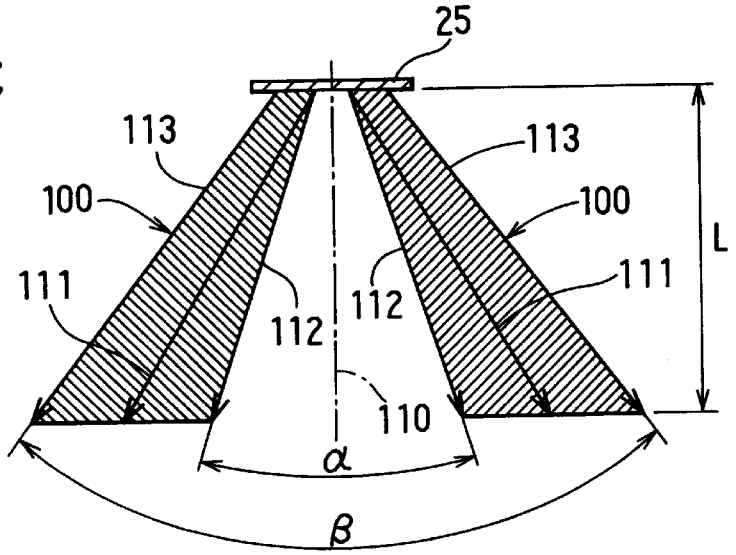
FIG. 1C is a side view of FIG. 1A viewed from an arrow IC in FIG. 1A according to the preferred embodiment of the present invention.

As shown in FIG. 1C, two extended lines 112 for two injection holes 25*b*, each injection hole 25*b* belongs to different group of the injection holes, form an angle of $\alpha$ between them when viewed from a direction of the arrow IC in FIG. 1A. Similarly, two extended lines 113 for two injection holes 25*c*, each injection hole 25*c* belongs to different group of the injection holes, form an angle of $\beta$ between them when viewed from a direction of the arrow IC in FIG. 1A.

It is to be noted that $\beta$ is greater than $\alpha$. Furthermore, an angle formed between two extended lines 111 for two injection holes 25*a* which form respective sprays 100 is greater than $\alpha$ and is smaller than $\beta$.

Each injection hole is formed such that the flow paths diverge from the injection center axis 110 as fuel advances in the fuel injection direction. Accordingly, the extended lines 111, 112 and 113 for respective injection holes diverge from each other as fuel advances in the fuel injection direction.

Accordingly, the fuel injected from the injection holes form the sprays 100 without colliding with each other. Thus, the spray 100 is uniformly atomized. Further, fuel sprays attract each other without colliding. Accordingly, deviation of the advancing direction of the spray 100 is prevented even if the value of t/d is small, and the spray 100 advances in the supposed direction.

In this preferred embodiment of the present invention, the "supposed direction" means, for example, two intake valves (not shown). The spray 100 has a conical shape and advances to the intake valve. Accordingly, wasting the fuel caused by unused fuel which adheres to a member around the intake valve, and the emission gas caused by such unused fuel are reduced.

In other words, the fuel injected from the plural injection holes do not collide each other and form a spray to advance in the supposed direction. Accordingly, the atomized fuel flows do not interfere each other and advance to the intake valves precisely to burn the atomized fuel efficiently.

The supposed direction is not limited to the intake valves, but may be a certain direction to a cylinder in a direct injection type in which a fuel injection valve is directly attached to a combustion chamber formed by the cylinder and a piston.

Further, according to the preferred embodiment, the intersections between the extended lines of the flow centers for six injection holes for forming the spray 100 and the hypothetical plane are approximately located on vertexes of the equilateral hexagon. In other words, the attraction forces between the fuel flows forming the spray 100 are approximately the same. Therefore, the spray 100 does not exceed the predetermined range and advances in a predetermined direction.

To know a shape of the intersections between the above hypothetical plane and the extended lines of flow path centers for each injection hole, non-fuel liquid may be used to measure it for a check instead of using the spray.

The shape of the spray is not limited to the equilateral hexagon, but may be another polygon, circle or ellipse according to a shape of an intake pipe of an engine.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A fuel injection nozzle comprising:

an injection hole member having a plurality of injection holes defining respective injected fuel flow path centers; and a valve member provided on a fuel inlet side of said injection hole member for enabling fuel to be intermittently injected through said injection holes, wherein;

said fuel injected through said injection holes forms a spray;

said injected fuel flow path centers diverge from an injection center axis as said fuel advances in an injection direction; and said injected fuel flow path centers diverge from each other as said fuel advances in said injection direction, wherein;

intersections between respective extended lines of said injected fuel flow path centers and a hypothetical plane which is spaced apart from said injection hole member by a predetermined distance and which is perpendicular to said injection center axis are located on vertexes of a polygon.

2. A fuel injection nozzle as in claim 1, wherein;

said injection holes are separated into at least two groups, each having at least two of said injection holes; and each of said groups forms said spray respectively.

3. A fuel injection nozzle as in claim 1, wherein said polygon includes an equilateral polygon.

4. A fuel injection nozzle comprising:

an injection hole member having a plurality of injection holes defining respective injected fuel flow path centers; and a valve member provided on a fuel inlet side of said injection hole member for enabling fuel to be intermittently injected through said injection holes, wherein;

said fuel injected through said injection holes forms a spray;

said injected fuel flow path centers diverge from an injection center axis as said fuel advances in an injection direction; and said injected fuel flow path centers diverge from each other as said fuel advances in said injection direction, wherein;

intersections between respective extended lines of said injected fuel flow path centers and a hypothetical plane which is spaced apart from said injection hole member by a predetermined distance and which is perpendicular to said injection center axis are located at approximately a same interval from each other.

5. A fuel injection nozzle as in claim 4, wherein;

said injection holes are separated into at least two groups, each having at least two of said injection holes; and each of said groups forms said spray respectively.

6. A fuel injection nozzle comprising:

an injection hole member having a plurality of injection holes defining respective injected fuel flow path centers; and a valve member provided on a fuel inlet side of said injection hole member for enabling fuel to be intermittently injected through said injection holes, wherein;

said fuel injected through said injection holes forms a spray;

said injected fuel flow path centers diverge from an injection center axis as said fuel advances in an injection direction; and said injected fuel flow path centers diverge from each other as said fuel advances in said injection direction, wherein;

a thickness of said injection hole member divided by a diameter of each one of said injection holes is greater than 0.35 and less than 0.75.

7. A fuel injection nozzle as in claim 6, wherein;

said injection holes are separated into at least two groups, each having at least two of said injection holes; and each of said groups forms said spray respectively.

8. A fuel injection nozzle comprising:

an injection hole member having a plurality of pair of injection holes, each of said pair of injection holes are disposed relative to each other in a mirror-image-like manner; and a valve member for enabling fuel to be intermittently injected through said injection holes, wherein;

an orifice angle formed by one of said pair of injection holes located closer to a center of said injection hole member than another pair of injection holes is smaller than that formed by said another pair of injection holes.

9. A fuel injection nozzle as in claim 8, wherein;

said plurality of pair of injection holes include twelve injection holes which are symmetrically disposed with respect to said center of said injection hole member.

* * * * *